US008844508B2

(12) United States Patent
Sims et al.

(10) Patent No.: US 8,844,508 B2
(45) Date of Patent: Sep. 30, 2014

(54) ARCHERY BOWS AND ARCHERY BOW COMPONENTS I

(75) Inventors: Steven C. Sims, Shelton, WA (US); Jonathan F. Seil, Shelton, WA (US)

(73) Assignee: Sims Vibration Laboratory, Inc., Shelton, WA (US)

( * ) Notice: Subject to any disclaimer, the term of this patent is extended or adjusted under 35 U.S.C. 154(b) by 45 days.

(21) Appl. No.: 12/930,039

(22) Filed: Dec. 23, 2010

(65) Prior Publication Data

US 2012/0006310 A1 Jan. 12, 2012

Related U.S. Application Data

(60) Provisional application No. 61/284,715, filed on Dec. 23, 2009.

(51) Int. Cl.
*F41B 5/14* (2006.01)
*F41B 5/10* (2006.01)
*F41B 5/12* (2006.01)

(52) U.S. Cl.
CPC . *F41B 5/10* (2013.01); *F41B 5/105* (2013.01); *F41B 5/123* (2013.01)
USPC ..... 124/25

(58) Field of Classification Search
USPC ..... 124/23.1, 25.6, 25
See application file for complete search history.

(56) References Cited

U.S. PATENT DOCUMENTS

| | | | | |
|---|---|---|---|---|
| 5,090,395 | A * | 2/1992 | Gannon | 124/25.6 |
| 7,784,452 | B1 * | 8/2010 | Kronengold et al. | 124/23.1 |
| 2005/0121012 | A1 * | 6/2005 | McPherson | 124/23.1 |
| 2007/0256675 | A1 * | 11/2007 | Smith et al. | 124/25.6 |
| 2008/0127961 | A1 * | 6/2008 | McPherson | 124/88 |
| 2009/0145411 | A1 * | 6/2009 | Sims et al. | 124/25.6 |
| 2009/0241928 | A1 * | 10/2009 | Blosser | 124/25.6 |
| 2010/0263650 | A1 * | 10/2010 | Dahl et al. | 124/25.6 |

* cited by examiner

*Primary Examiner* — Gene Kim
*Assistant Examiner* — Amir Klayman
(74) *Attorney, Agent, or Firm* — Wells S. John, PS

(57) ABSTRACT

Compound bows and cross bows with flexible bow limbs and novel, limb-associated mechanisms for adjusting the poundage of the bow. Each flexible bow limb (or element of a split limb bow) is bent against a fulcrum located between the leading and trailing ends of the bow limb or limb element. A poundage adjuster at the same location as the fulcrum or at the leading edge of the limb or limb element is used to set the curvature in the limb (The poundage of the bow is directly related to the curvature of the limb or limb element). An independently acting poundage mechanism as just described is preferably provided for both limbs of a solid limb bow and for all four limbs of a split limb bow. Also disclosed are novel bottom (or power) cams which have reduced lean and wobble during the end part of bow draw, thereby reducing noise and vibration as an arrow is shot from the bow and contributing to the accuracy of the bows in which they are installed.

17 Claims, 18 Drawing Sheets

ARCHERY BOWS AND ARCHERY BOW COMPONENTS I

CROSS-REFERENCE TO A RELATED APPLICATION

The benefit of the filing date of provisional application No. 61/284,715 filed 23 Dec. 2009 is claimed.

TECHNICAL FIELD OF THE INVENTION

The present relates to archery bows, and more specifically, to such bows having: (1) novel poundage adjusters, and/or (2) novel cams with significantly reduced lean and wobble.

DEFINITIONS

Buss Cable: Also known as a power cable. It is this cable which deflects an upper bow limb when a hybrid cam bow is drawn.

Control Cable: This cable deflects the lower limb of a hybrid cam bow when the bow is drawn. This cable also synchronizes the movement of the bow's upper and lower cams.

Poundage: The maximum force required to draw a bow.

Hybrid Cam Bow: One with a control cam at the upper end of the bow and a power cam at the lower end of the bow.

Split Limb Bow: One in which upper and lower limbs each have two spaced apart limb elements. These are also commonly referred to as bows with four limbs, two upper and two lower.

Bow Limb Component: A term used herein to refer to either a solid or split bow limb or toan element of a split bow limb.

BACKGROUND OF THE INVENTION

Provision is generally made to adjust the poundage of a compound archery bow. This allows the archer to tailor the bow to his particular physical capabilities and the use to which he is putting the bow.

Typically, a screw-type adjuster is employed for this purpose. This approach is disadvantageous in that the person has to keep in mind or guess at the number of turns or other displacement of the adjuster; and this is an unwanted complication, particularly if the adjustment is being made in the field. Also, the prior art poundage adjusters typically alter the geometry of the bow as the poundage adjustment is made by changing the brace height of the bow. Geometrical alterations can significantly, and adversely, affect the performance of the bow.

Prior art bows with screw-type poundage adjusters are disclosed in the following U.S. Pat. No. 4,178,905 to Groner; U.S. Pat. No. 5,464,001 to Peck; U.S. Pat. No. 5,720,267 to Walk; U.S. Pat. No. 6,024,076 to Laborde, et al., and U.S. Pat. No. 6,244,259 to Adkins.

Hsu U.S. Pat. Nos. 5,388,563 and 5,411,008 disclose poundage adjusters which feature an indexing arrangement for facilitating poundage adjustment. However, these mechanisms are specifically designed for recurve bows; and there is nothing even remotely suggesting how they could be used or adapted for compound bow poundage adjustment. At the least, this adaptation would require extensive experimentation and redesign. Furthermore, the Hsu approach requires a locking nut and an Allen wrench for tightening and loosening the nut. This is an unwanted complication because of the additional parts required and one which is not considered suitable for field use because of the ease with which the Allen wrench might be lost or misplaced.

A hybrid compound bow has cam-anchored control and buss cables which time and otherwise control the rotation of the bow's upper and lower cams. In a conventional bow, these cables place unbalanced loads on the cam(s). This causes the bottom cam to lean and wobble as the bow is drawn and as an arrow is subsequently shot from the bow. Such phenomena produce significant and unwanted noise and vibration and a significant and obviously unwanted decrease in the accuracy of the bow. A patent addressing these problems is U.S. Pat. No. 6,659,096 to Nealy, Sr., et al. However, the patented approach is believed to be unnecessarily complicated; and it is designed for use only in single cam bows.

SUMMARY OF THE INVENTION

Disclosed herein are novel compound archery bows with novel and decidedly superior poundage adjusters. Also disclosed are equally novel and improved cams with features which significantly reduce, if they do not entirely eliminate, cam lean and wobble.

The compound bows of the present invention have a rigid riser and flexible limbs mounted at their leading ends to the upper and lower ends of the riser. Cams are supported on fixedly positioned axles at the trailing, free ends of the limbs. A bow string and a harness composed of a control cable and a buss cable, all placed under tension, extend between the upper and lower cams, fixing the distance between the cam axles and loading the limb components of the bow.

The poundage of the bow is adjusted by bending each of one or more limb components of the bow over a displaceable fulcrum located between the forward and trailing ends of the limb component. If the fulcrum is displaced outwardly from the centerline of a poundage adjuster axle, the bend in the limb component will become steeper. This increases the load on the limb component and, as a consequence, the force required to draw the bow. Conversely, if the limb component is allowed to relax and move inwardly at the fulcrum, the load on the limb component is decreased; and less force is required to draw the bow.

In one embodiment of the invention a rotatable, stepped, axle-supported poundage adjustment cam is fixedly mounted to the riser of the bow at the location of the fulcrum by a complementary cam shaft is advanced to move the fulcrum outwardly and increase the bend in the limb; and the tendency of the limb to relax when the cam is backed off allows the fulcrum to move inwardly and decrease the bend in the limb. As discussed above, these outward and inward displacements of the fulcrum respectively increase and decrease the poundage of the bow.

The cam steps are flats disposed seriatim around the exposed surface of the cam and contactable with the limb. Successive flats are located at incrementally increasing distances from the cam's fixed axis of rotation. Consequently, as the cam is rotatably advanced, the distance of the limb from the axial centerline of the cam axle is increased in incremental steps with corresponding increases in the bend in and load on the limb and, consequently, the poundage of the bow. Backing off the cam stepwise decreases the bend in the limb in predetermined increments with corresponding decreases in the load on the limb and the poundage of the bow.

Because the steps are flat and because the limb is biased against the active step, that step positively engages the facing surface of the limb and keeps the adjustment from shifting without the use of locking nuts or other complicating components.

Integrated with the poundage adjuster cam is a user-manipulatable knob. Indices on this knob allow the person making the poundage adjustment to easily and readily view the adjustment that has been made.

Because the timing and geometry of a bow with poundage adjusters of the present invention remain essentially unchanged as the bow poundage is adjusted, accuracy is not degraded by changing the bow poundage. Also, the novel poundage adjustment systems disclosed herein allow one to independently adjust all of the limbs or limb elements of a compound bow; and the bow does not need to be retuned after a poundage adjustment.

Optionally, the two poundage adjusters in a pair of such adjusters can be made to operate in unison if one wishes.

The novel poundage adjusters are adaptable to a variety of solid and split limb compound bows and solid and split limb cross bows including, without limitation, binary cam, hybrid cam, and solo (single) cam compound and cross bows.

The poundage adjusters are user friendly, light in weight, and simple. The importance of these advantages is self-evident.

Other preferred embodiments of the invention employ a variable radius cam and a cam-associated locking pin or spring-loaded detent or the like to shift the fulcrum about which the limb is bent. In still other preferred embodiment of the invention, the cam mechanism is located at that forward end of the limb where it is attached to the bow riser; and a separate fulcrum is disposed at a location between the forward and trailing ends of the bow.

In each case bow setting indicia are provided. These allow one to easily determine the poundage to which a limb or limb element has been set. In contrast, the prior art screw type poundage adjusters require one to count the number of turns of the screw; and this burdensome, particularly in the field.

Cams which can be used to great advantage not only in bows of the character disclosed herein, but in compound bows and cross bows in general are also disclosed herein. In one respect these cams are improvements of the solo cam disclosed in U.S. Pat. No. 5,505,185 to Miller.

Conventionally, the buss and control cables of a compound bow are both located on the same side of the cam(s) over which they run. Cams set up in this manner tend to lean and wobble as the bow is drawn and as an arrow is then shot from the bow. Lean and wobble increase noise and vibration and significantly detract from the accuracy of the bow.

A cam embodying the principles of the present invention is constructed such that the control and buss cables run on opposite sides of the cam wheel. This equalizes the loads on the cam axle, significantly reducing cam lean and wobble. That in turn reduces noise and vibration and promotes the accuracy of the bow in which the cam is installed.

Preferably, one or more spiral cable or string tracks are provided to keep the control cable, buss cable, and/or bow string out of contact with the sharp cam wheel edge as the bow is drawn and to offsets the changing loads on the cam axle generated as the bow is drawn. To best accomplish the latter objective, the cam track may spiral outwardly or spiral inwardly or have both inwardly and outwardly spiral segments which come into play during different parts of the draw.

Also preferred, and located on the buss cable side of the cam, are a cable-wide gap through which the buss cable runs and an angled ramp separated by a gap from the buss cable side of the cam wheel. The ramp guides the buss cable into the gap, thereby holding the buss cable against the buss cable side of the cam wheel as the bow is drawn. This straightens the cam wheel and/or keeps it from leaning during the draw, making a still further significant contribution to noise and vibration reduction and to the accuracy of the bow.

An option is to use a large radius component on the buss cable side of the bow instead of the above-described ramp to guide the buss cable as the bow is drawn.

An optional cable guide system mounted to the riser of the bow a short distance above the bottom cam can be employed to keep the control cable out of contact with the control cable side of the cam as the bow is drawn and an arrow is shot, further contributing to noise and vibration reduction and accuracy.

Other significant features and advantages of the present invention will be apparent to the reader from the foregoing and the appended claims and from the accompanying drawings taken in conjunction with the detailed description of the invention.

DETAILED DESCRIPTION OF THE INVENTION

Figure 1:
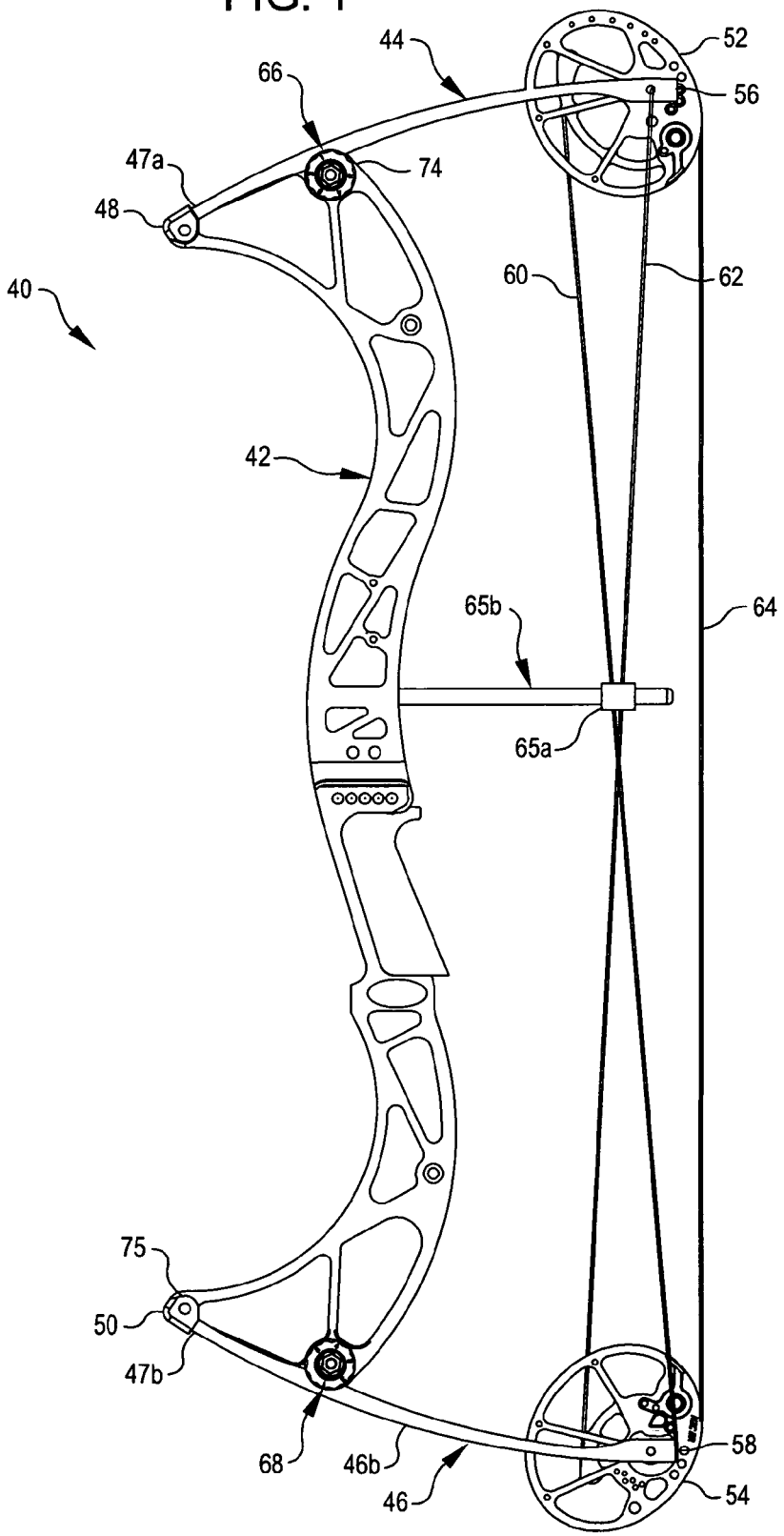
FIG. 1 is a side view of a hybrid compound bow with split limbs; the bow has poundage adjusters embodying the principles of the present invention.

Referring now to the drawings, FIG. 1 depicts a split limb, hybrid cam, compound bow 40 constructed in accord with the principles of the present invention. Bow 40 has a rigid riser 42 and flexible, upper and lower split limbs 44 and 46. Limb 44 has two, spaced apart limb elements 44*a* and 44*b* pivotably mounted at their leading ends (see 47*a* in FIG. 6) to riser 42 in pockets 48*a* and 48*b* which are pivotably mounted to the upper end 74 of riser 42 on a pin 49 extending through the riser. The lower limb elements (only element 46*b* is shown) are similarly mounted to the lower end 76 of riser 42. This mounting arrangement advantageously allows each element 44*a* and 44*b* of limb 44 and the two elements of limb 46 (only element 46*b* is shown) to flex over its entire length.

Rotatable, axle-supported cams 52 and 54 are mounted to the trailing ends (or tips) 56 and 58 of limbs 44 and 46. Control and buss cables respectively identified by reference characters 60 and 62 and a bow string 64 are strung between upper and lower cams 52 and 54, control cable 60 and buss cable 62 being trained through a riser-mounted cable slide 65*a* mounted on a guide rod 65*b* located approximately midway between the upper and lower ends 74 and 76 of riser 42.

Figure 1A:
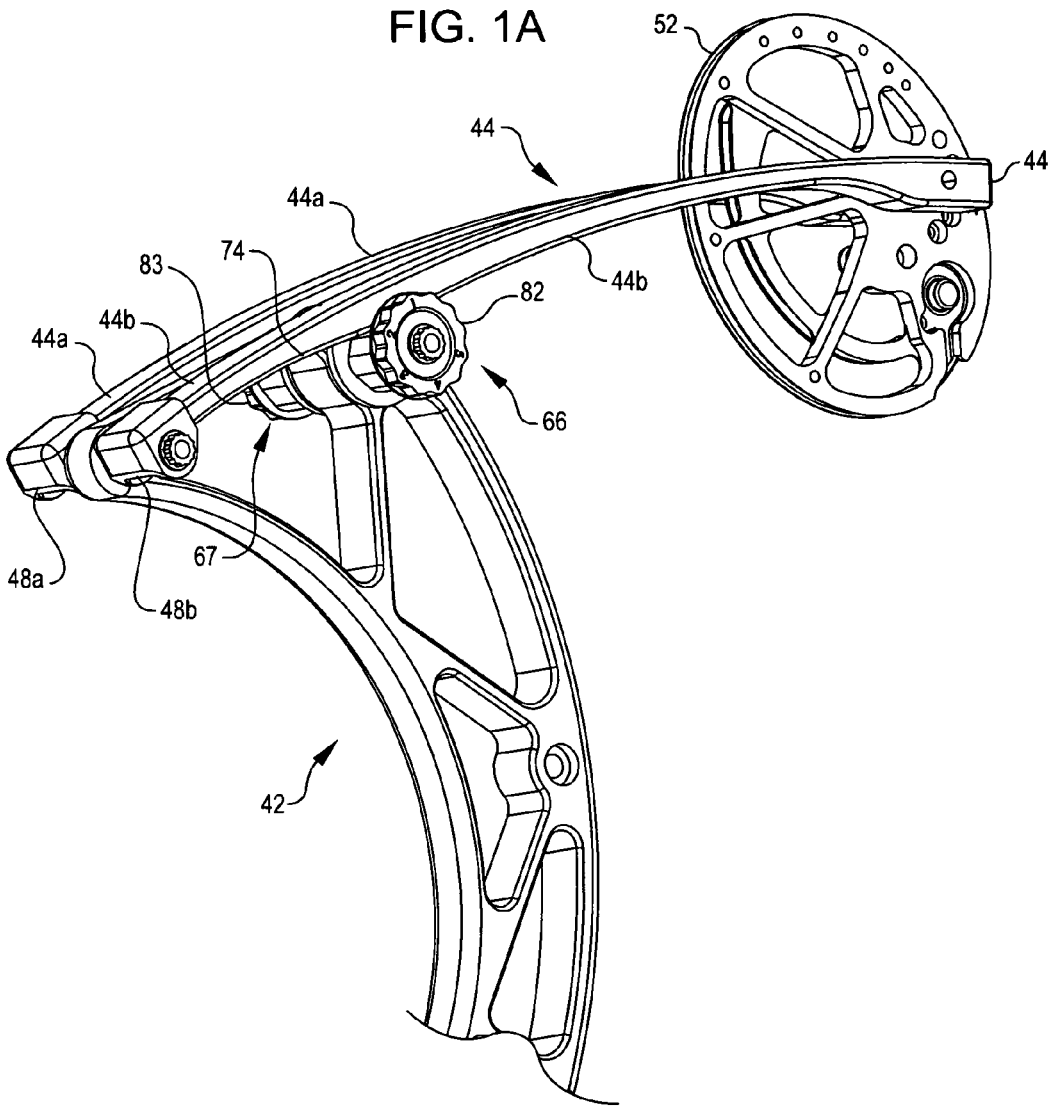
FIG. 1A is a perspective view of the upper part of the FIG. 1 bow 1; it shows to advantage first and second poundage adjusters for independently setting the poundage each of the elements of the upper split limb of the FIG. 1 bow.

It is very advantageous for the archer to be able to adjust the poundage of a compound bow such as exemplary bow 40. To this end, bow 40 is equipped with a pair of novel poundage adjusters 66 and 67 mounted to the upper end 74 of riser 42 (see FIG. 1A) and a second pair of poundage adjusters mounted to the lower end 76 of the riser (only one of these poundage adjusters is shown; it is identified by reference character 68). This provision of four, independently operable poundage adjusters is important as it enables one to set all four limb elements of bow 40 to the same poundage (or to different poundages if such is desired). Similarly, a solid limb bow in accord with the principles of the present invention will have independently operable, upper and lower poundage adjusters for independently setting the poundages of the upper and lower limbs.

Referring again to the drawings, only the upper poundage adjusters 66 and 67 of the FIG. 1 split limb bow will be described in detail herein, it being understood that the description of those poundage adjusters is equally applicable to the lower poundage adjuster 68.

Turning next to FIGS. 2-6, upper poundage adjuster 66 includes a fulcrum 70 supported from the upper end 74 of riser 42 at a location 76 between the leading and trailing ends 47*a* and 56 of upper bow limb element 44*b* by a riser-mounted axle 80 about which the fulcrum can rotate. A fulcrum 81 of poundage adjuster 67 is also supported from axle 80 for rotation thereabout.

A poundage adjustment knob 82 which is typically an integral part of the same component as fulcrum 70 is provided for rotating fulcrum 70; and a poundage adjustment knob 83 of the same character is provided for rotating fulcrum 81.

The two poundage adjustment fulcrums 70 and 81 are of like character. Accordingly, only fulcrum 70 will be described in detail herein.

Figure 6:
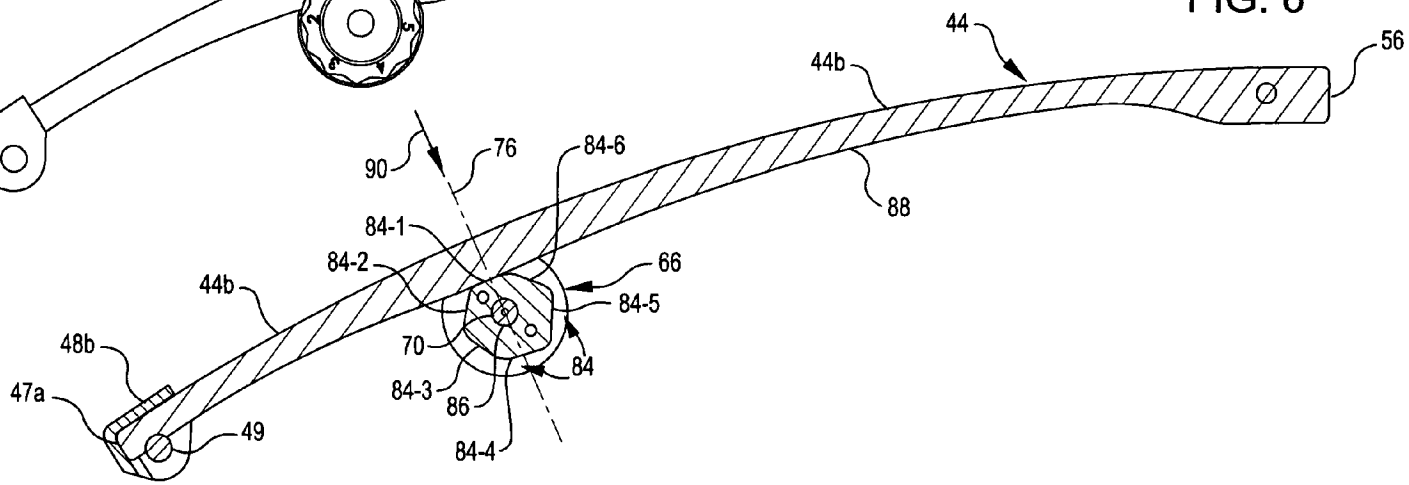
FIG. 6 is a section through FIG. 4, taken substantially along line 6-6 of the latter figure; it shows the fulcrum-defining flats of the rotatable poundage adjuster component.

As best shown in FIG. 6, the periphery of fulcrum 70 is composed of a series of six flat steps 84-1 through 84-6 (collectively 84) with successive flat steps 84-1 through 84-5 being at incrementally greater radial distances from the fulcrum's axis of rotation 86. Typically, the incremental distance will be 0.02 inch. However, neither this incremental radial distance nor the number of flats is critical; and these parameters may accordingly be varied as desired.

The sixth flat step 84-6 is a transition flat between the lowest step 84-1 and the highest step 84-5; that is, between the steps closest to and furthest from axis of rotation 86. This flat is not otherwise employed to adjust the poundage of bow 40.

The under side 88 of upper bow limb element 79 is contacted by a user-selected one of the five-poundage adjustment cam steps 84-1-84-5 rotated into engagement with limb side 88 using knob 82.

As limb element 44*b* is constrained at its forward end 47*a* by pocket 48*b* and at its trailing end 56 by bow string 64, control cable 60, and buss cable 62, the limb is bent around fulcrum 70 to a degree determined by the particular flat 84 in contact with the lower side 88 of bow limb element 44*b*. The degree of bend is increased as successive flats 84 are rotated into contact with the under side 88 of the bow limb element. As the bend in limb element 44*b* is increased, the force tending to restore the limb element toward an unflexed or rest configuration is increased. This translates into the force required to draw the bow, i.e., into an increase in the poundage of the bow.

Figure 2:
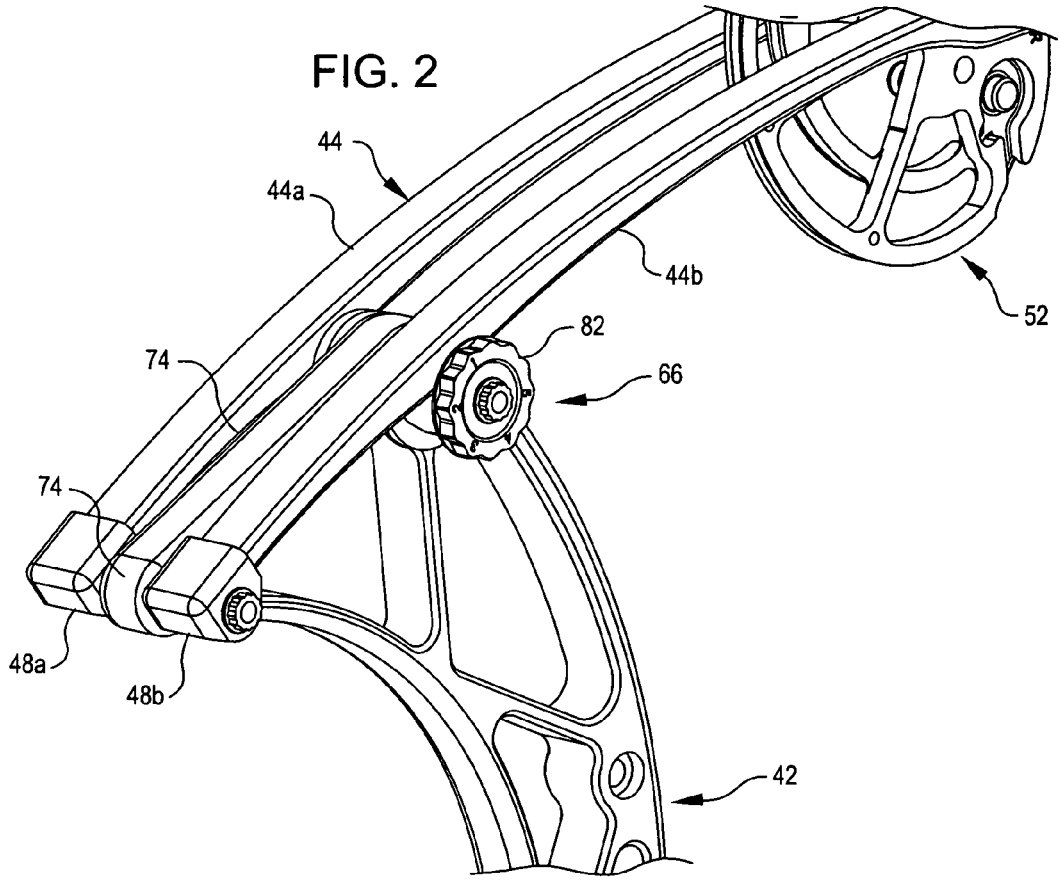
FIG. 2 is a partial perspective of the FIG. 1 bow drawn to an enlarged scale; this figure shows one of the poundage adjusters in more detail.
Figure 3:
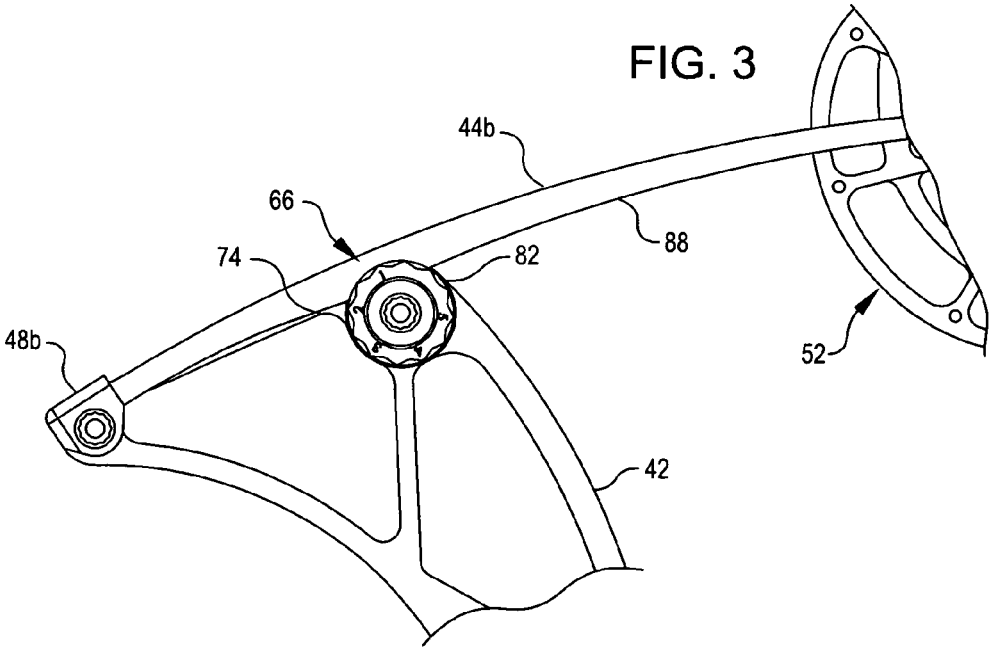
FIG. 3 is a partial side view of the FIG. 1 bow; it shows essentially the same part of the bow that FIG. 2 does.
Figure 4:
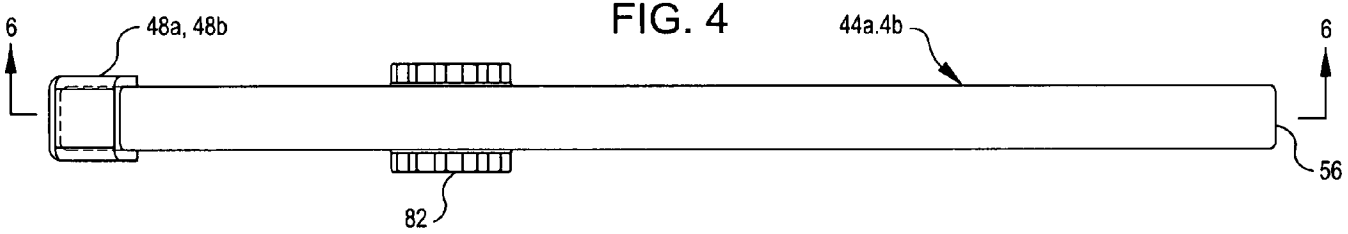
FIG. 4 is a plan view of the bow limb, the poundage adjuster, and a pin-supported, pivotable pocket for mounting the limb to the riser of the bow.
Figure 5:
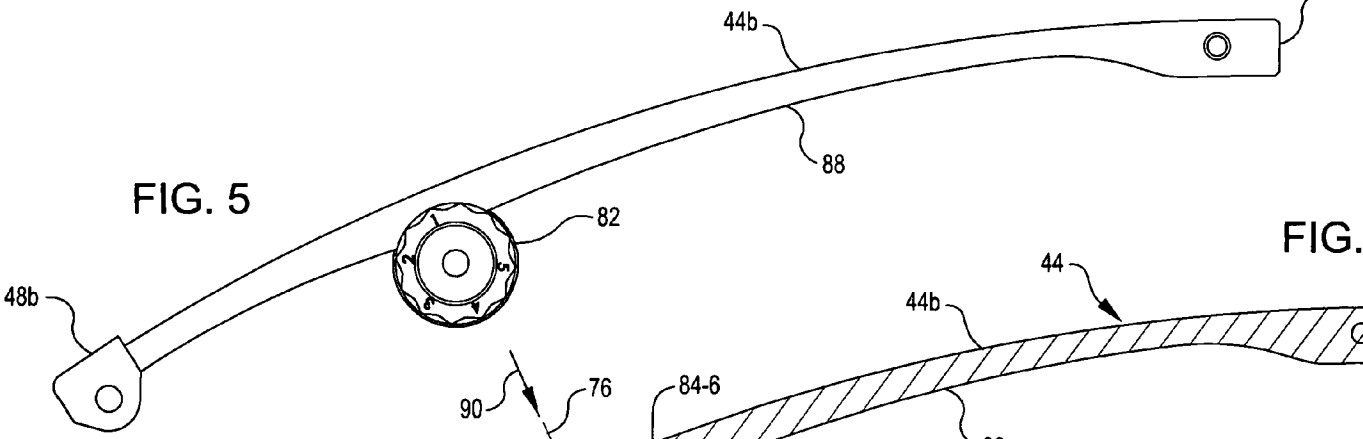
FIG. 5 is a side view of the bow limb, the poundage adjuster, and the limb-mounting pocket.

As shown in FIGS. 2, 3, and 5, poundage adjustment knob 82 is preferably labeled opposite fulcrum cam steps 84-1 through 84-5 with the numerals 1 through 5. This allows the person making a poundage adjustment to easily ascertain the amount to which the poundage of the bow has been increased or decreased.

Typically, bringing successive cam steps 84 into contact with limb element 79 will increase or decrease the poundage of the bow by two pounds. Again, however, there is nothing critical in this particular parameter; it may also accordingly be varied as desired.

In conjunction with the foregoing, it will also be appreciated that the relatively large area of contact between the active flat 84 of fulcrum 70 and the lower side 88 of limb element 44*b* forced against that step by the stress in that limb element (see arrow 90 in FIG. 6) locks the active step in place absent the application of a deliberate rotational force to poundage adjustment knob 82; this advantageously eliminates the need for a locking device such as the nut and Allen wrench system disclosed in the above-cited Hsu patents '563 and '008 and the complications, complexity, and expense attributable to these and other locking mechanisms.

Fulcrum 81 similarly acts on the second element 44*a* of upper limb 44 and bends that element to a degree selected by the rotation of control knob 83. The two elements of lower split bow limb 46 can similarly be independently bent to the wanted degree by the fulcrums (not shown) at the bottom of bow 40. That each of the four limb elements can be independently adjusted is a huge advantage. It allows all four split limb elements to be set with precision to the same poundage or to selected different poundages if that is wanted.

Poundage adjusters employing the principles of the present invention and having the advantages thereof may differ considerably in appearance and construction from the exemplary poundage adjusters 66, 67, and 68 described above in conjunction with FIGS. 1-6 of the drawings. Disclosures of a very limited number of representative alternatives are described below and illustrated in FIGS. 7-21 of the drawings. To the extent that components shown in these figures are duplicates of or similar to corresponding components of above-discussed compound bow 40, they will for the most part be identified by the same reference characters.

Figure 7:
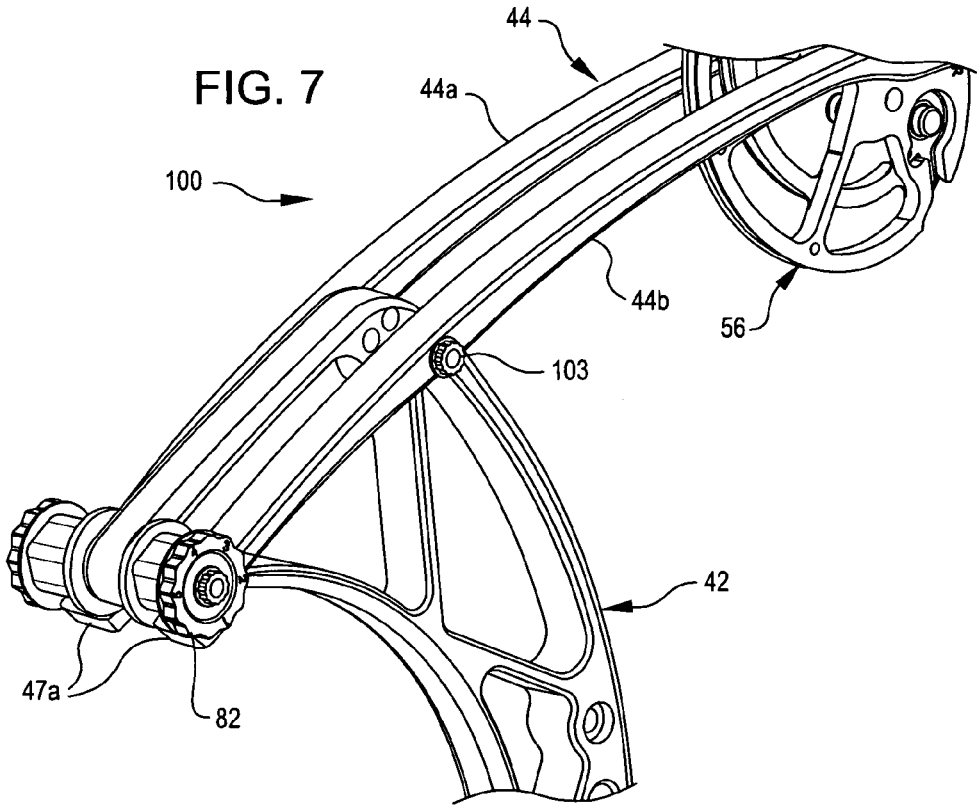
FIG. 7 is a partial isometric view of a second embodiment of the invention; in this embodiment the poundage adjuster is located at the leading end of the limb, and the steps of a stepped cam press against this end of the bow to bend the limb about a fulcrum and thereby adjust the poundage.
Figure 8:
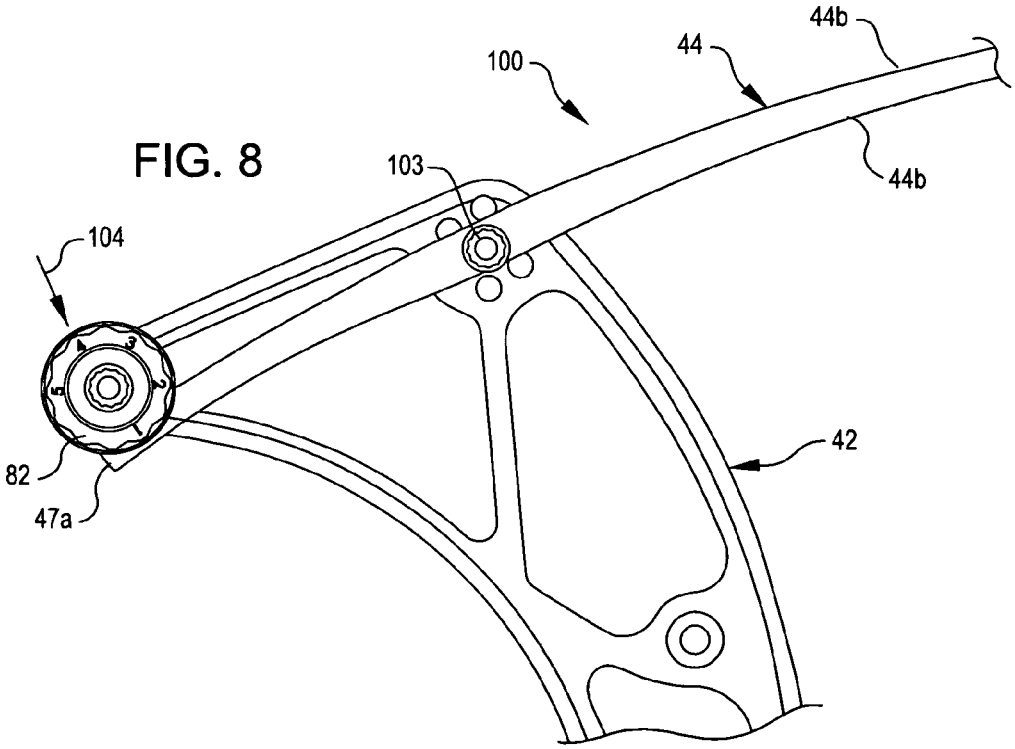
FIG. 8 is a side view of the FIG. 7 bow showing the poundage adjuster and the limb fulcrum in more detail.
Figure 9:
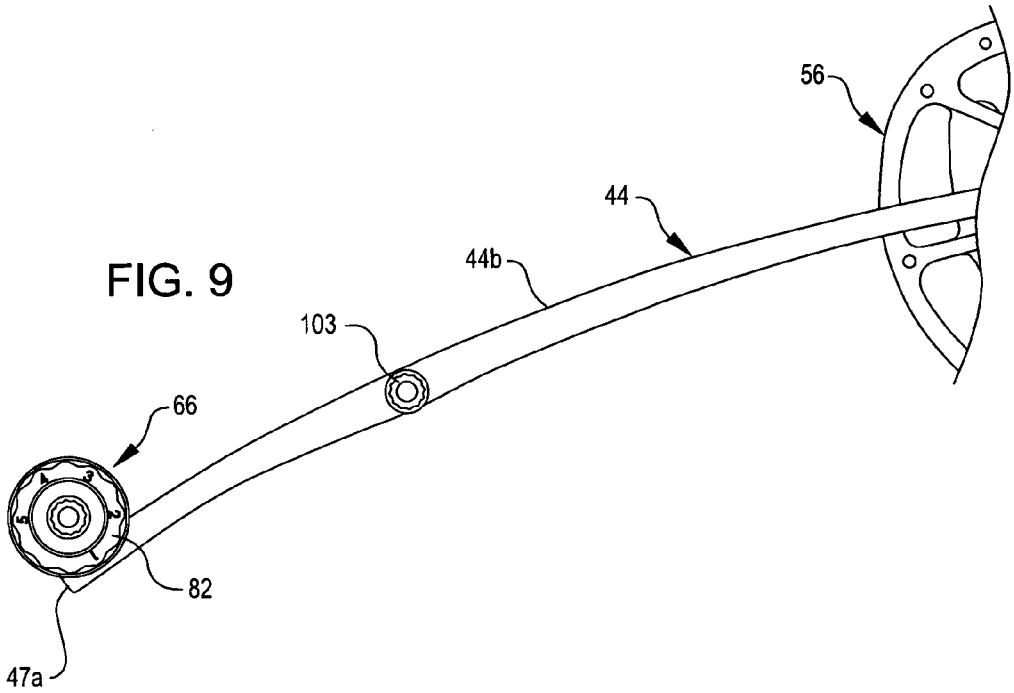
FIG. 9 is a second side view of the FIG. 7 bow; in this figure the bow riser has been omitted to better show the poundage adjuster and the fulcrum.
Figure 10:
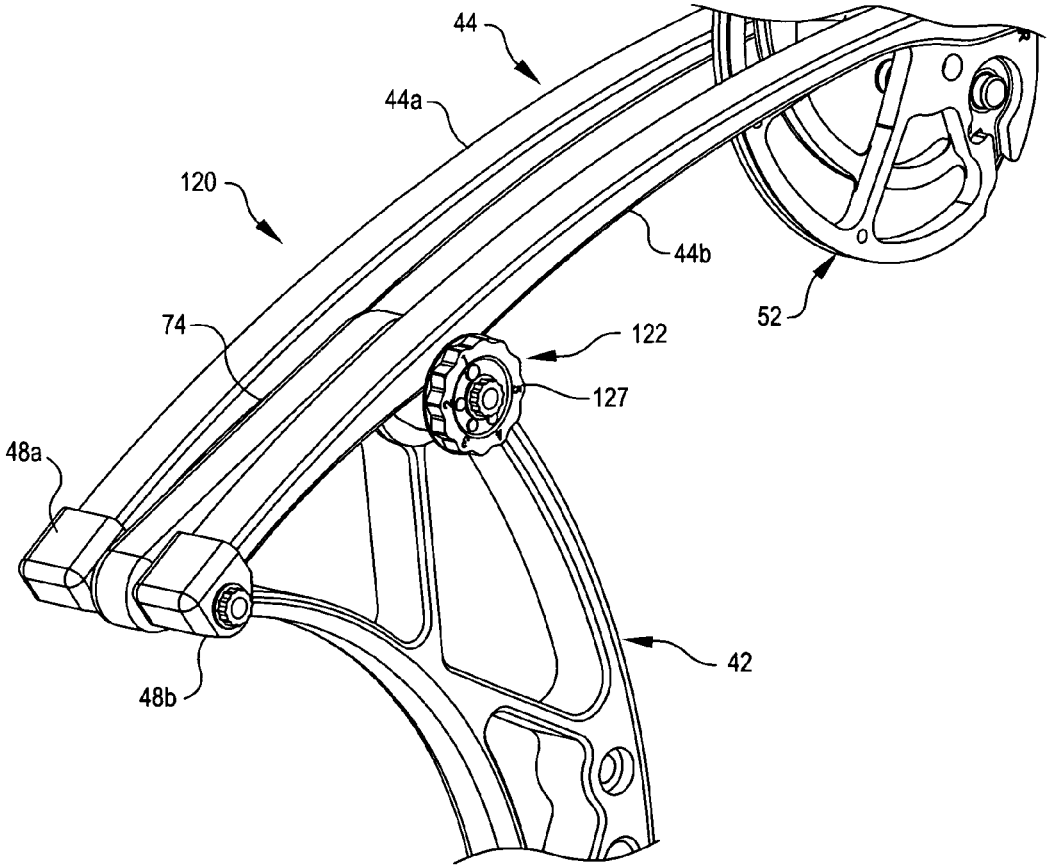
FIG. 10 is a partial isometric view of a third embodiment of the invention; in this embodiment, a poundage adjuster comprising a rotatable, variable radius, lobe-type cam is employed to adjust the poundage of the bow.
Figure 11:
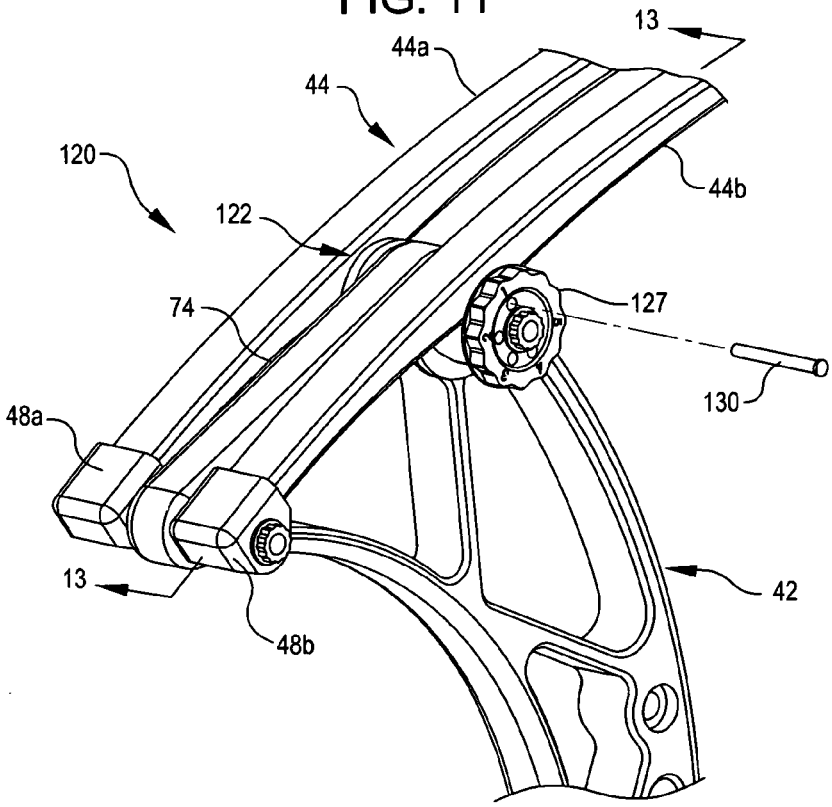
FIG. 11 is a partially exploded isometric view of the FIG. 10 bow, showing a pin which is employed to lock the rotatable, poundage adjuster cam in a selected position providing the wanted poundage.
Figure 12:
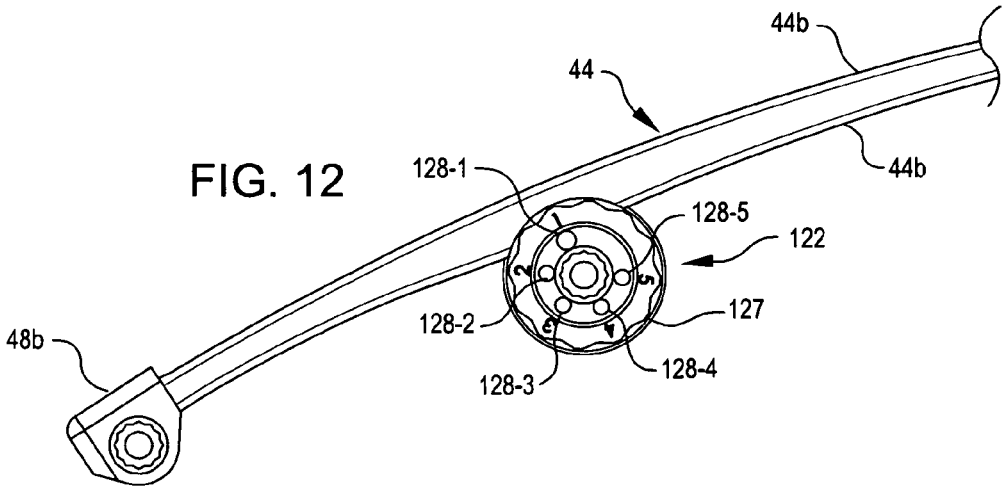
FIG. 12 is a side view of the bow limb, the poundage adjuster, and the pocket mounting the limb to the bow riser.
Figure 13:
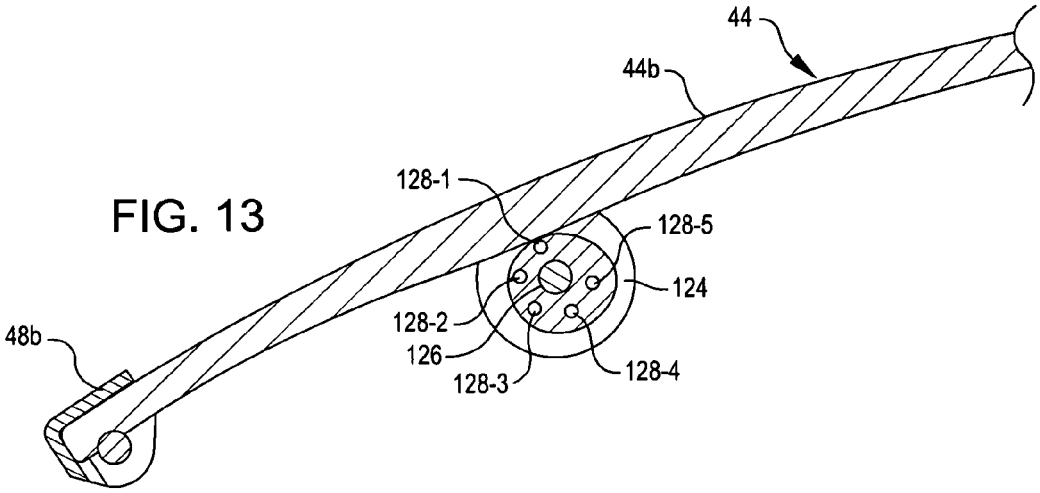
FIG. 13 is a section through the limb, poundage adjuster, and pocket, taken substantially along line 13-13 of FIG. 11.
Figure 14:
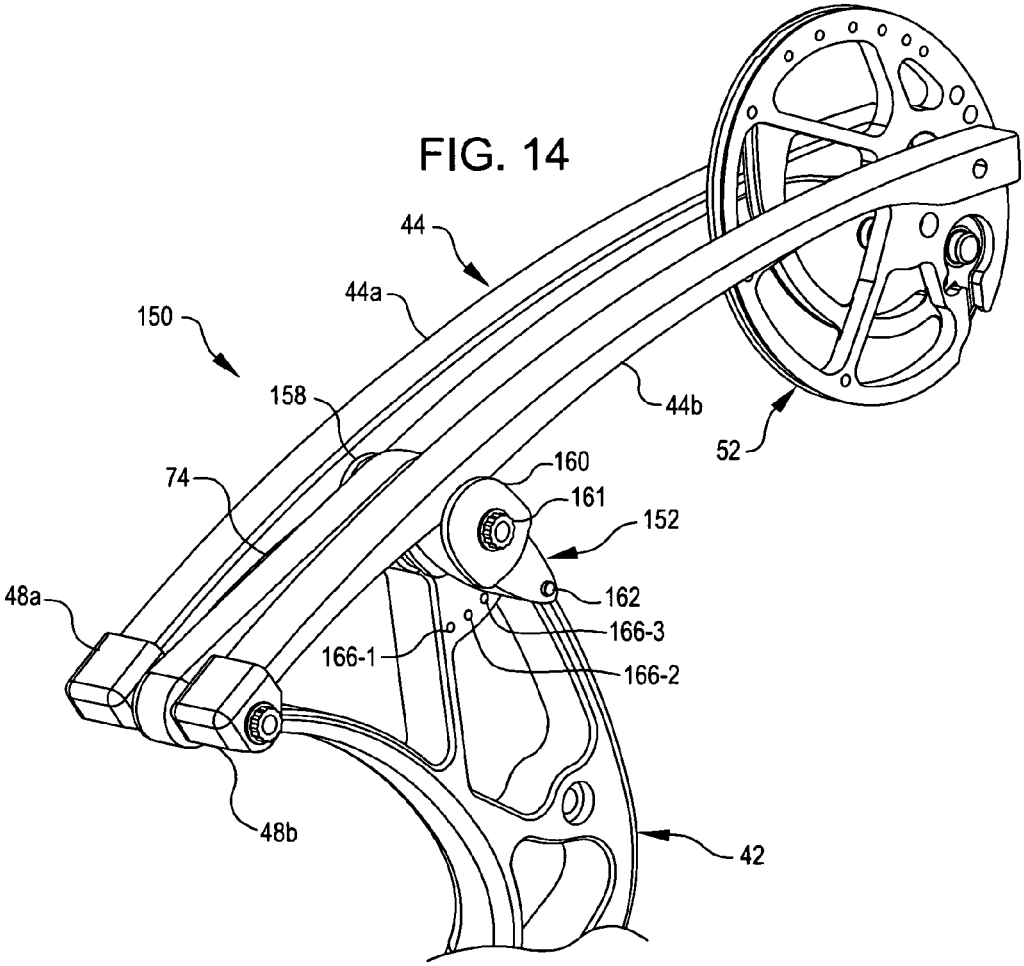
FIG. 14 is a partial isometric view of a fourth embodiment of the invention; the bow shown in this figure also employs a poundage adjuster with a variable radius, lobe-type cam.

FIGS. 7-9 depict a split limb compound bow 100 which differs from bow 40 in that poundage adjuster 66 has been relocated to the leading end of limb element 44*b* where it is mounted to riser 42 and by the addition of a fulcrum 102 located between the leading and trailing ends of limb element 44*b* (only the leading end 47*a* of the limb is illustrated in FIGS. 7-9.) A fulcrum 102 (see FIG. 7) retained in place by a nut 103 extends through upper limb elements 44*a* and 44*b* and riser 42. This locates the upper limb elements relative to the riser.

Limb element 44*b* is bent over fulcrum 102 to a user-selected extent to provide the wanted bow poundage. Specifically, in this embodiment of the invention, the active cam step 84 of poundage adjuster 66 pushes down on the leading tip or end 47*a* of limb element 44*b* as indicated by arrow 104 with a force determined by the distance that the active cam step is spaced from the axial centerline (axis of rotation) 86 of the adjuster. This produces a corresponding bend in limb element 44*b* about fulcrum 102 and, as a consequence, the wanted bow poundage. Again, force applied to limb tip 47*a* in the arrow 104 direction with the limb under load locks poundage adjuster 66 against rotation, making the use of complicating, additional components for this purpose unnecessary.

FIGS. 10-13 depict a split limb compound bow 120 of the same general character as above-described and illustrated bow 40. Bow 120 has an upper poundage adjuster 122 featuring a variable radius lobe 124 for making poundage adjustments and a lower poundage adjuster of the same type (not shown). Lobe 124, also serving as a fulcrum about which limb element 44*b* is bent, is mounted to riser 42 by a riser-supported axle 126.

To set the bow poundage, lobe 124 is rotated until an appropriate segment of lobe 124 corresponding to the wanted bow poundage engages the bottom side 88 of limb element 44*b*. A user-manipulatable knob 127 integrated into a single component with lobe 124 is utilized to rotate the lobe until the wanted lobe segment comes into contact with the lower side 88 of limb element 44*b*.

Numerals 1 through 5 spaced around knob 127 allow the person setting the bow poundage to ascertain the segment of the lobe that is in contact with bow surface 88 and, as a consequence, the poundage to which the bow is set.

In this embodiment of the invention, a set 128 of apertures 128-1-128-5 is formed in adjuster knob 127. A locking pin 130 installed through the aperture 128 in knob 127 corresponding to the selected bow poundage indicator 1-5 and extending into a complementary aperture (not shown) in riser 42 locks lobe cam 124 against rotation, positively maintaining the cam in the position to which it has been rotated.

FIGS. 14-17 depict a split limb compound bow 150 which also features a rotatable variable radius, fulcrum providing lobe cam for setting the bow poundage. This lobe is identified by reference character 152. Poundage adjustment lobe cam 152 is mounted to and rotates on riser-supported cam axle 156. Limb element 44*a* is trapped between lobe cam fins 158 and 159, and limb element 44*b* is trapped between lobe cam fins 160 and 161. This insures that limb elements 44*a* and 44*b* remain in alignment.

In a manner akin to that discussed above in conjunction with bow 120, lobe cam 152 is rotated by an operator-manipulatable poundage adjustment knob 161 integrated with lobe cam 152 to bring a segment of the lobe corresponding to a desired bow poundage setting into contact with the bottom or lower side 88 of limb element 44*b*. Though not shown in FIGS. 14-17, riser 42 will have poundage indicia such as the above-discussed numbers 1-5 so that the person making the poundage setting or adjustment can easily, visually ascertain the setting that has been selected.

Figure 15:
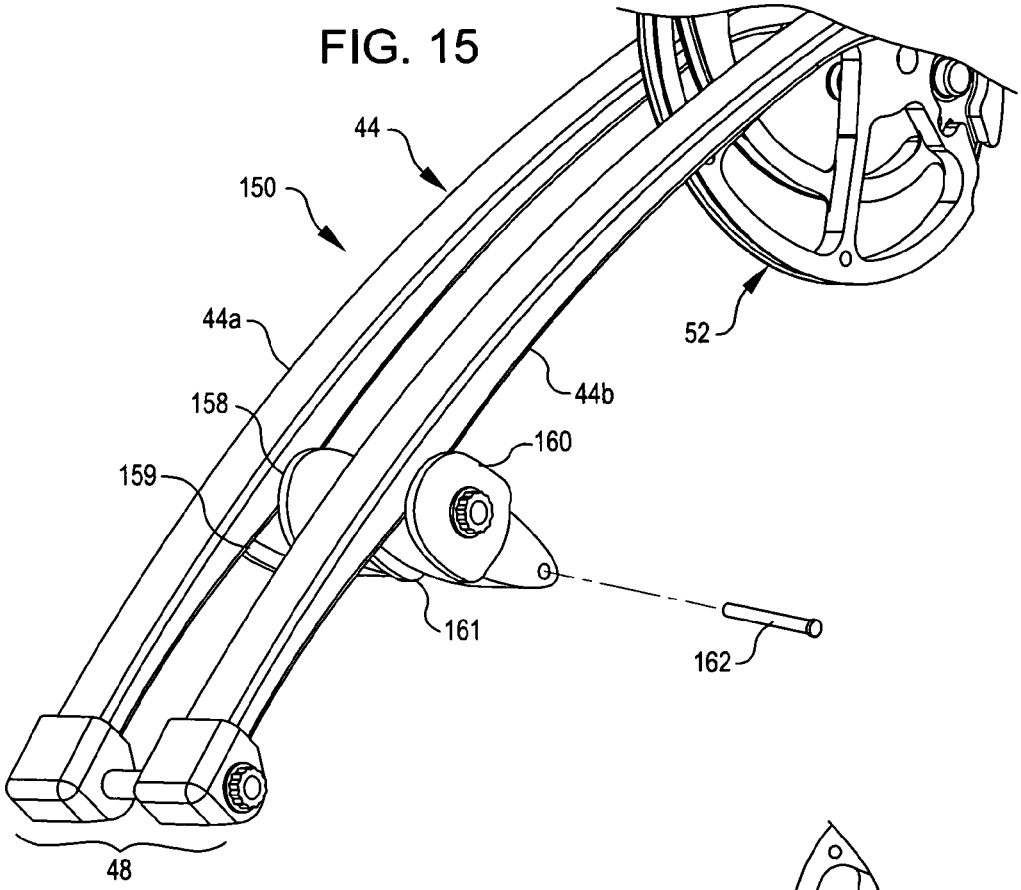
FIG. 15 is a partial isometric view of selected elements of the FIG. 14 bow; viz., the bow limb, a cam at the tip end of the limb, the poundage adjuster, and the pocket mounting the limb to the bow riser.
Figure 16:
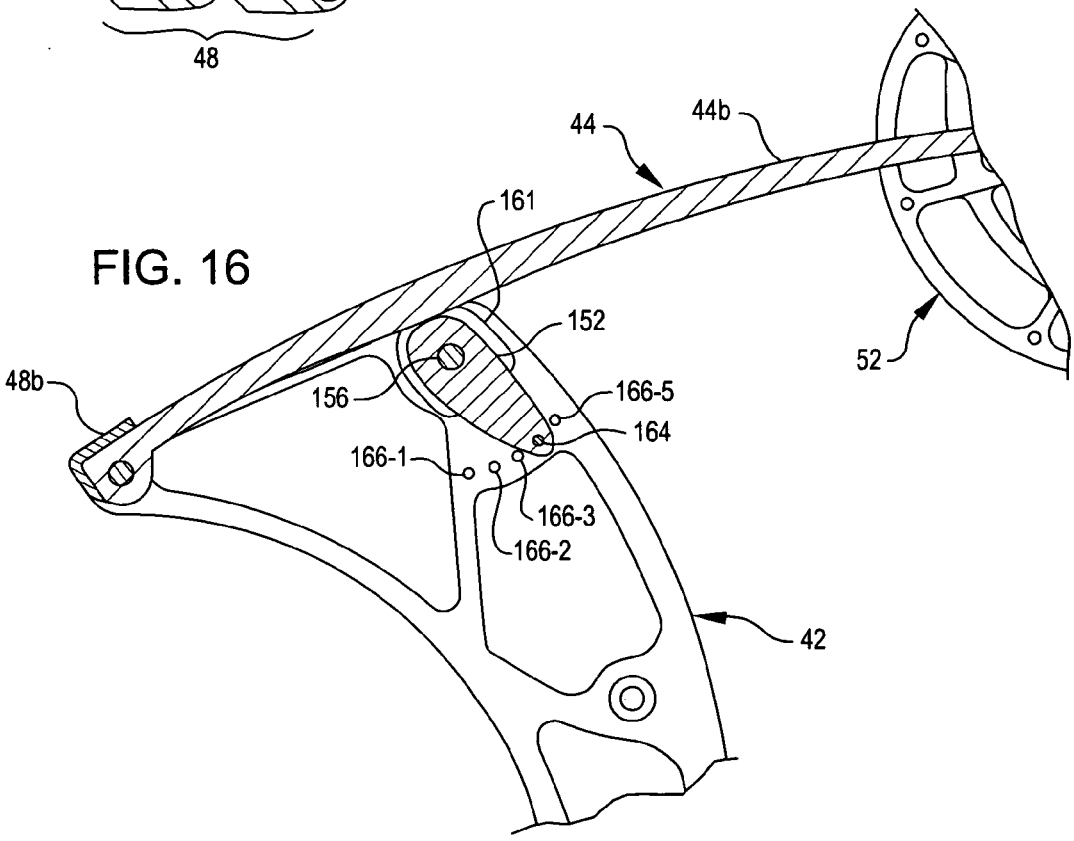
FIG. 16 is a fragmentary, partially sectioned side view of the FIG. 14 bow.
Figure 17:
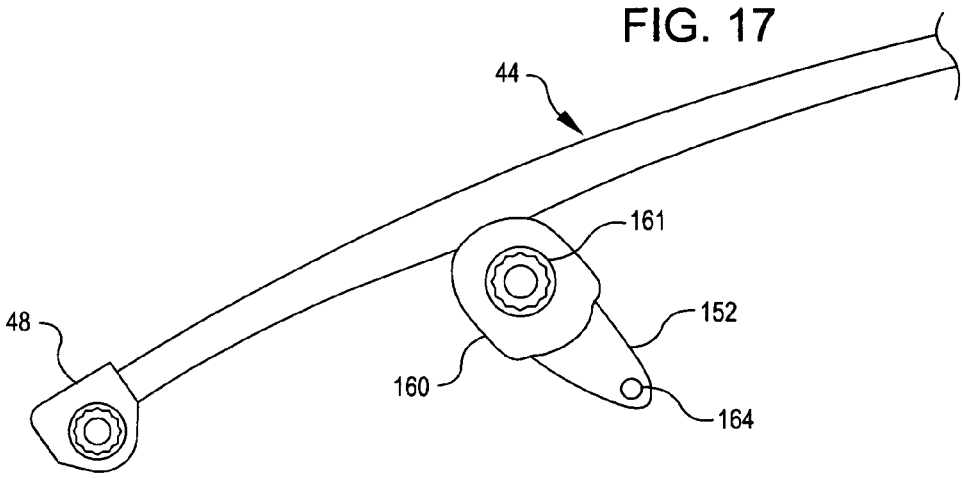
FIG. 17 is a side view of the FIG. 14 flexible bow limb, the poundage adjuster, and the limb mounting pocket.
Figure 18:
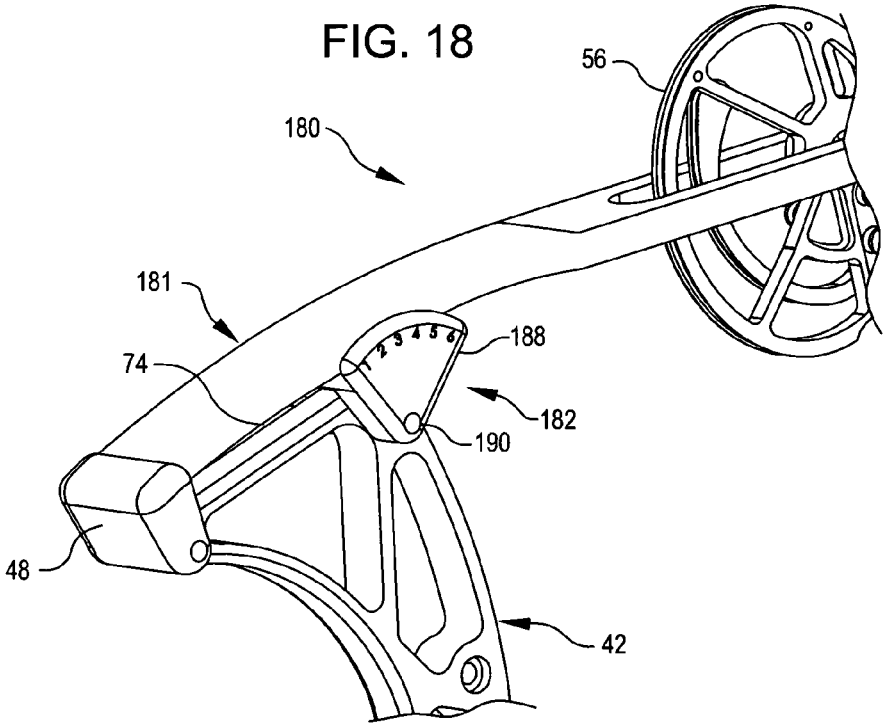
FIG. 18 is a partial perspective of a solid limb compound bow equipped with a step cam poundage adjuster constructed in accord with, and embodying, the principles of the present invention.
Figure 19:
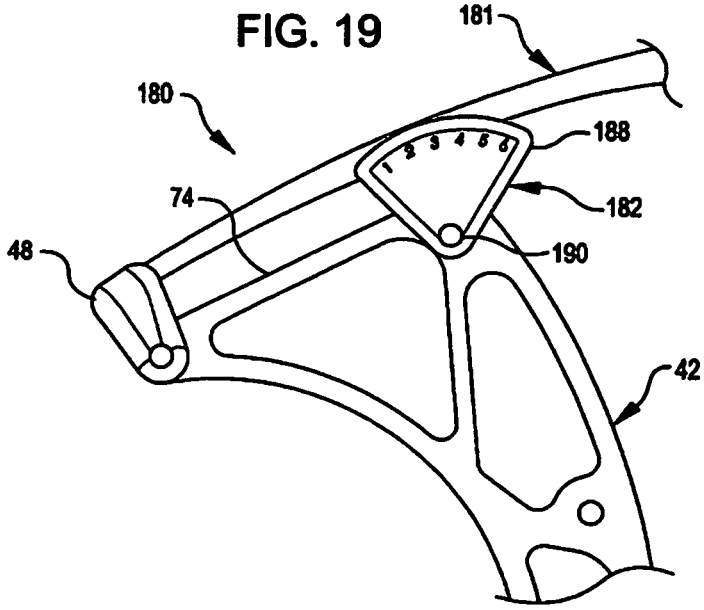
FIG. 19 is a partial side view of the FIG. 18 bow.
Figure 20:
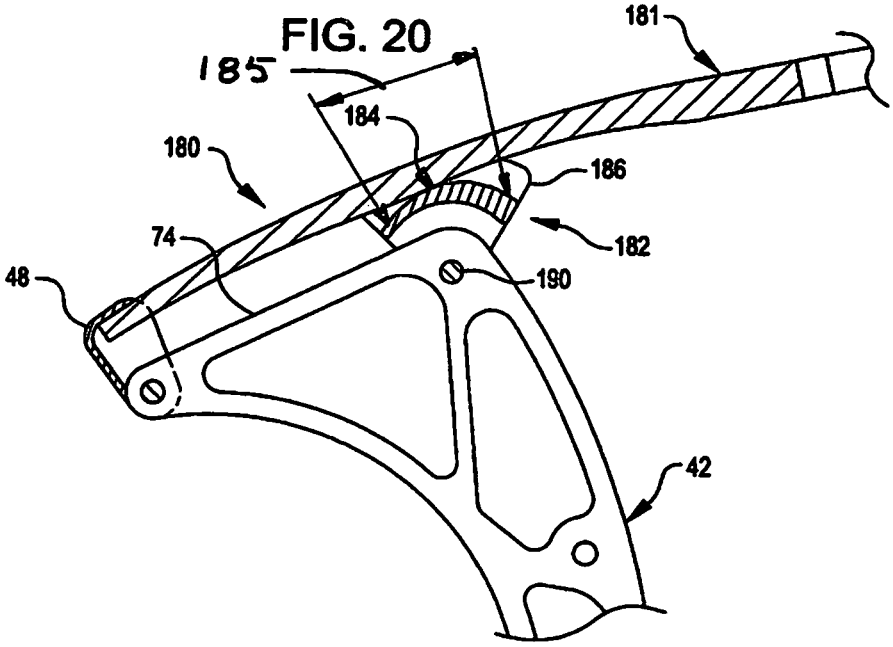
FIG. 20 is a longitudinal section through the FIG. 18 bow.
Figure 21:
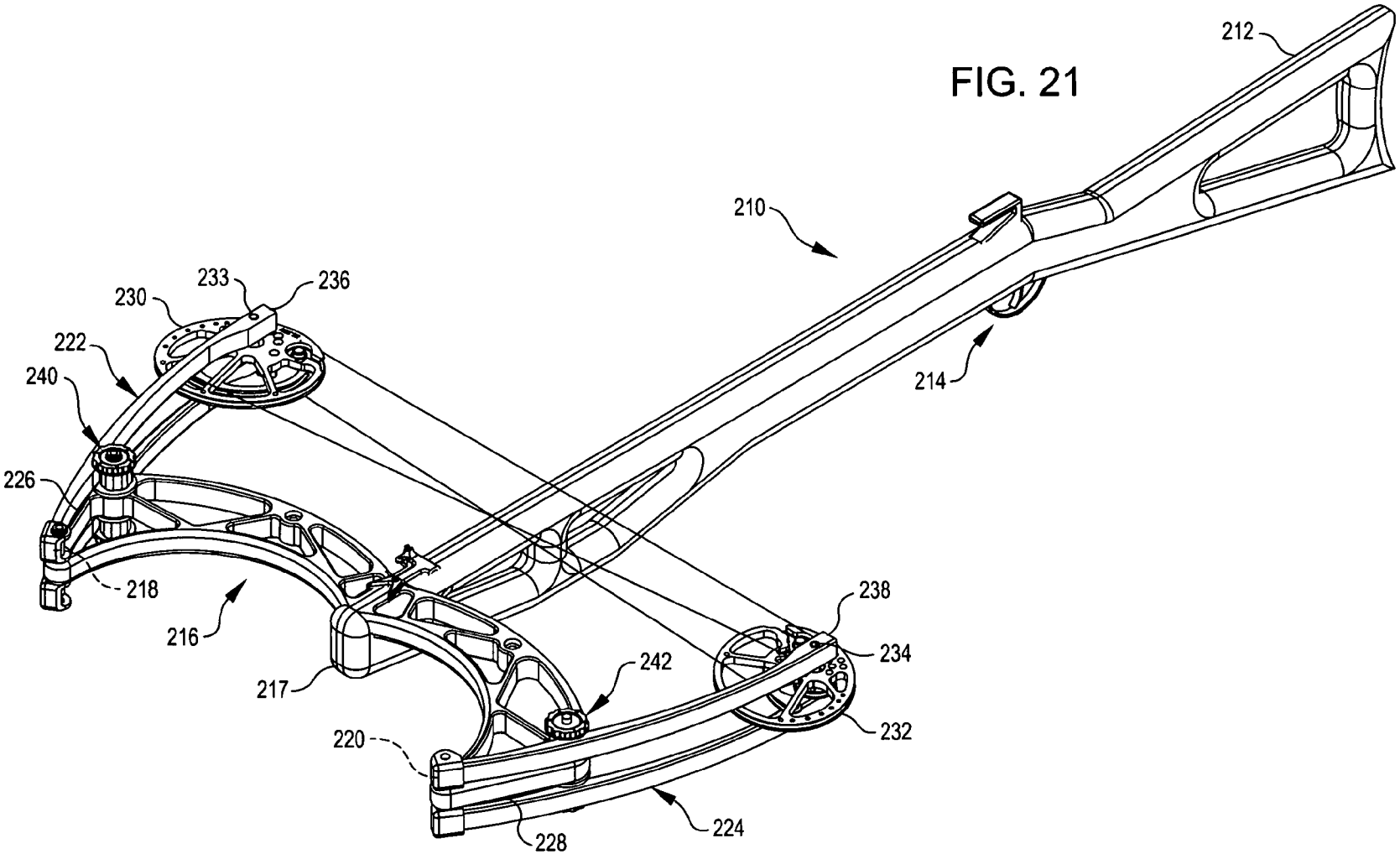
FIG. 21 is a perspective view of a cross bow equipped with a poundage adjuster as illustrated in FIGS. 1-6 and described above.
Figure 22:
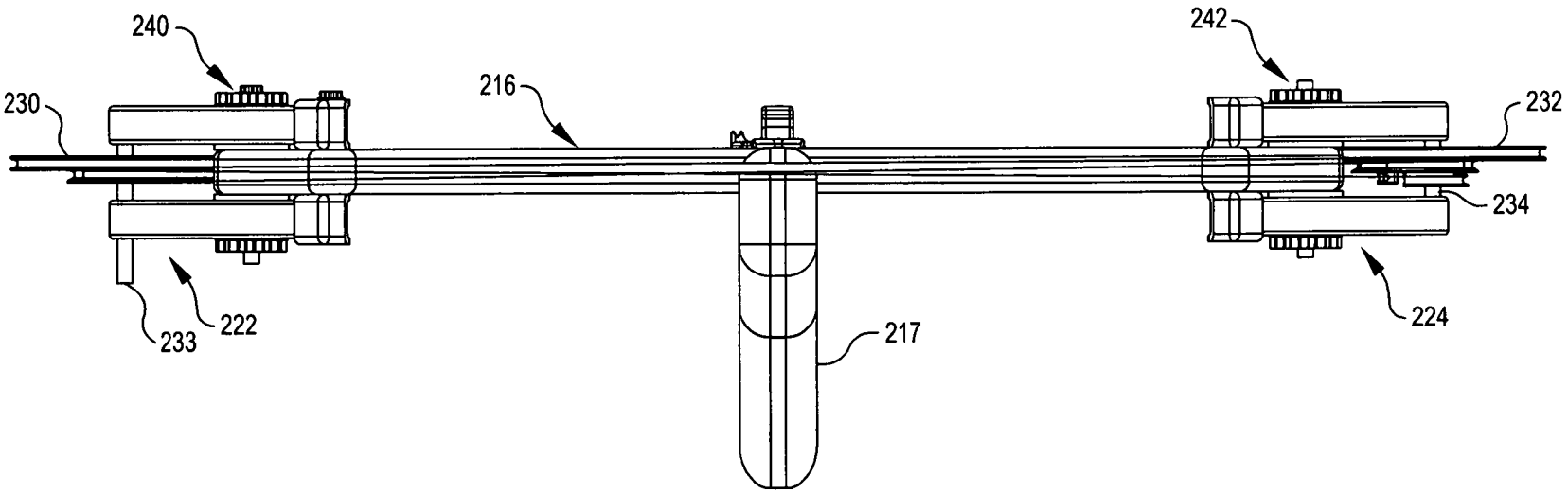
FIG. 22 is a front view of the FIG. 21 bow, looking toward the rear (or stock) end of the bow.
Figure 23:
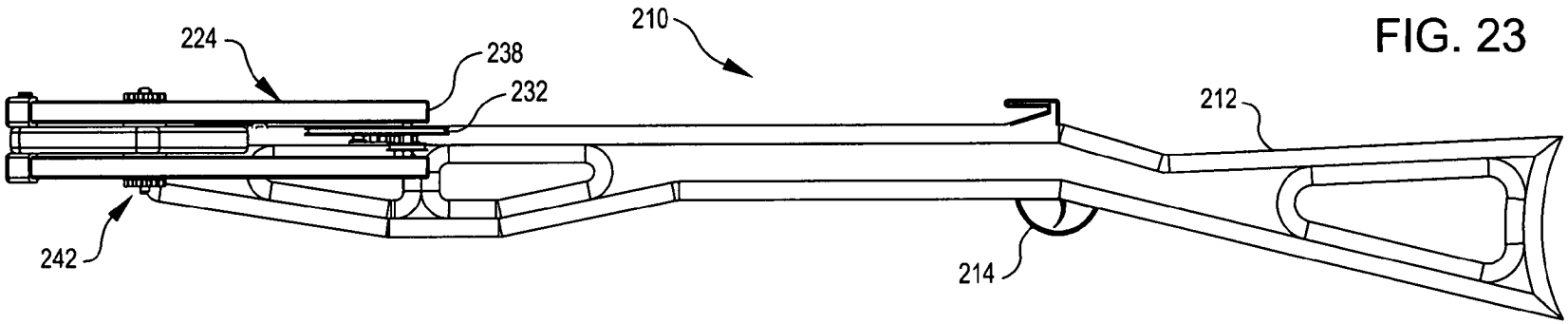
FIG. 23 is a side view of the FIG. 21 bow.
Figure 24:
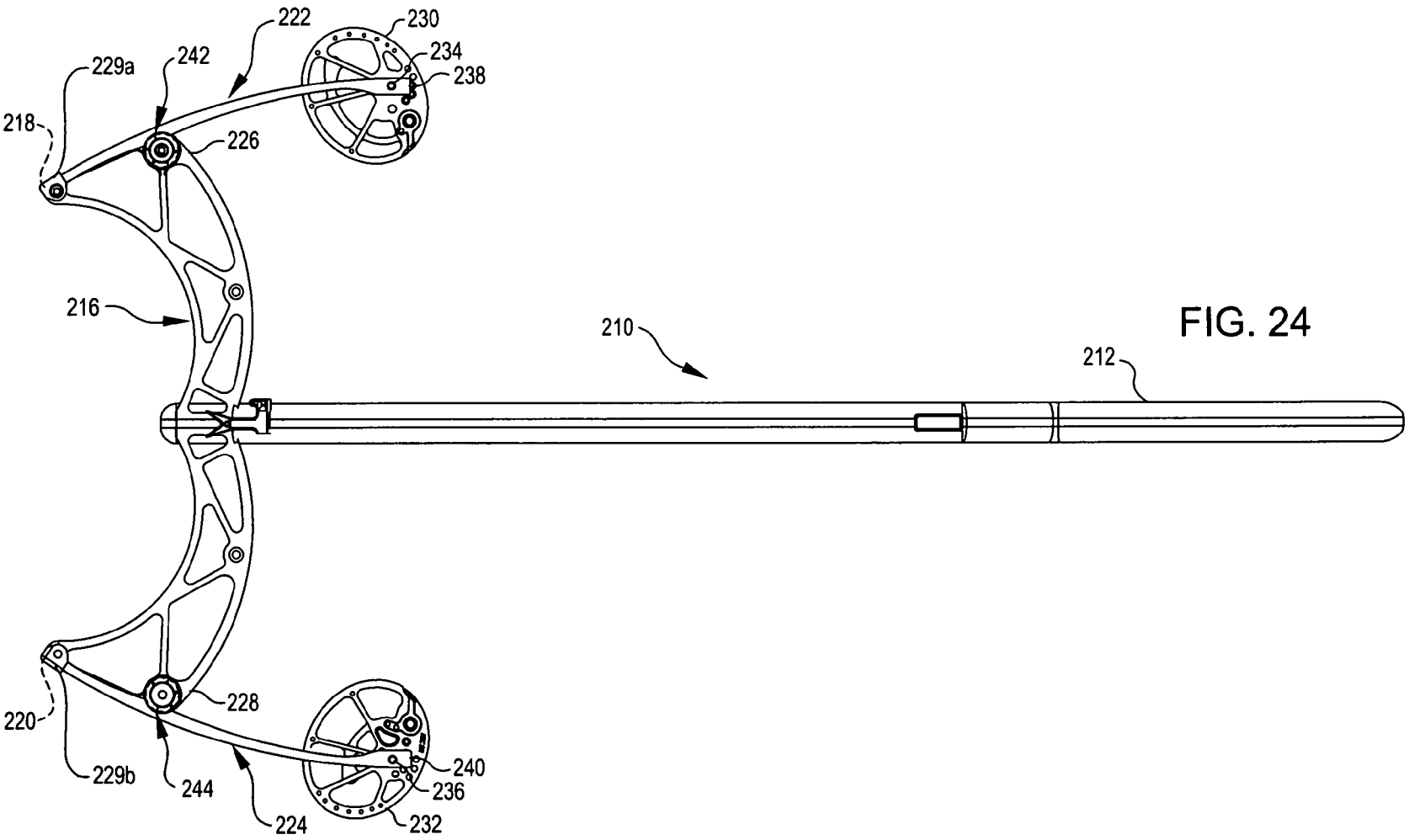
FIG. 24 is a top view of the FIG. 21 bow.

Cam lobe 152 is locked into the position corresponding to the selected poundage setting by a locking pin 162 (see FIG. 15). This pin is pushed through an aperture 164 in cam 152 into one of the five apertures in riser 42 corresponding to the typical five settings of the cam to lock the cam in place. Four of the riser-associated holes are shown in FIG. 16 and identified by reference characters 166-1 et seq. in FIG. 16.

FIGS. 18-22 illustrate a bow 180 which has solid limbs (only upper limb 181 is shown) and which is equipped with poundage adjusters employing step cams. The upper poundage adjustment mechanism (the only one shown) is identified by reference character 182, and the step cam is identified by reference character 184. The steps are identified collectively by reference character 185 in FIG. 20.

Step cam 184 is integral with the inner side 186 of a user-manipulatable poundage adjustment actuator 188. The actuator is rotatably supported on an axle 190 from the upper end 74 of riser 42 with the cam bearing against the lower surface 88 of bow limb 44.

Numerals 1-6 spaced at intervals corresponding to incremental and successively higher poundage settings around the periphery 194 of poundage adjustment actuator 182 allow the person setting the poundage or making an adjustment to easily, visually ascertain the setting which has been selected. The flat surface engagement between limb 44 and the active cam step effectively locks the cam in place at the selected setting.

As stated above, poundage adjusters embodying the principles of the present invention provide the same benefits and advantages when used in compound cross bows as they do when used in hybrid cam compound bows. A split limb, compound cross bow thus equipped is illustrated in FIGS. 21-24 and identified by reference character 210. Except for its employment of poundage adjusters employing the principles of the present invention, cross bow 210 is of conventional construction. It has the customary stock 212 and trigger mechanism 214 and a transversely extending riser 216 mounted to the forward end 217 of the stock. At their leading ends 218 and 220, rearwardly extending, flexible bow limbs 222 and 224 are supported in pivotable pockets 229*a* and 229*b* from the right-hand and left-hand ends 226 and 228 of rigid frame 216 (see FIG. 24). Cams 230 and 232 are rotatably supported from flexible bow limbs 222 and 224 by axles 233 and 234 at the trailing or trailing ends 236 and 238 of the limbs. These cams may be of the same character and have the same modus operandi and benefits as the cams employed in compound bows.

Step cam poundage adjusters 240 and 241 are mounted to the right-hand end 226 of rigid frame 216, and poundage adjusters 242 and 243 of the same character as poundage adjusters 66, 67, and 68 are mounted to the riser left-hand end 228, all in the same manner that poundage adjusters 66, 67, and 68 are mounted to riser 42 of the compound bow 40, again at locations between the leading and trailing ends 218 and 236 of limb 222 and the leading and trailing ends 218 and 238 of limb 224. Poundage adjusters 240-243 may be essentially identical to the poundage adjuster 66 described in detail above with reference to FIGS. 1-6 of the drawings. They operate in the same manner as the latter to make poundage adjustment available and give cross bow 210 the same benefits and advantages that poundage adjustment mechanism 66 gives a compound bow. The four poundage adjusters 240, 241, 242, and 243 operate independently; and the poundage of split limb elements 222*a*, 222*b*, 224*a*, and 224*b* can therefore all be easily set to the same poundage (or to different poundages, if one wishes).

Other of the several poundage adjustment mechanisms disclosed herein can be employed instead of a step cam poundage adjuster like poundage adjuster 66 as can still other cams employing the principles of the present invention.

It was also pointed out above that there is disclosed herein a novel, improved cam which can be employed to advantage in hybrid cam bows to minimize cam lean and wobble as a bow equipped with it is drawn and as an arrow is subsequently shot from the bow. In one respect, the cam is an improvement on the cam disclosed in U.S. patent to Miller.

It is common, in hybrid cam bow construction, for the control and buss cables to be anchored to the lower cam on the same side of the cam wheel. It has now been discovered that the cam lean and wobble and the noise and vibration attributable to this arrangement can be significantly minimized by relocating the buss cable to the opposite side of the cam wheel from the control cable. This innovation balances the loads on the cam axle, which significantly reduces cam lean and wobble.

A cam of the character just described is shown in FIGS. 25-28 and identified by reference character 400. Cam 400 is rotatably supported by axle 402 from the trailing tip of a bow limb such as shown in FIG. 1 and identified by reference character 46*b*.

Cam 400 includes an elliptical, asymmetrically supported cam wheel 404, with a control cable side 406 and a buss cable side 408. A string track 410 is formed around the periphery of cam wheel 404. Bow string 64 runs in this cam track.

Control cable and buss cable elements 412 and 414 are part of or fixed to cam wheel 404 on the control and buss cable sides 406 and 408 of the cam wheel. A control cable track 416 is provided in the periphery of control cable element 412, and a buss cable track 418 is formed in the periphery of buss cable element 414.

Figure 25:
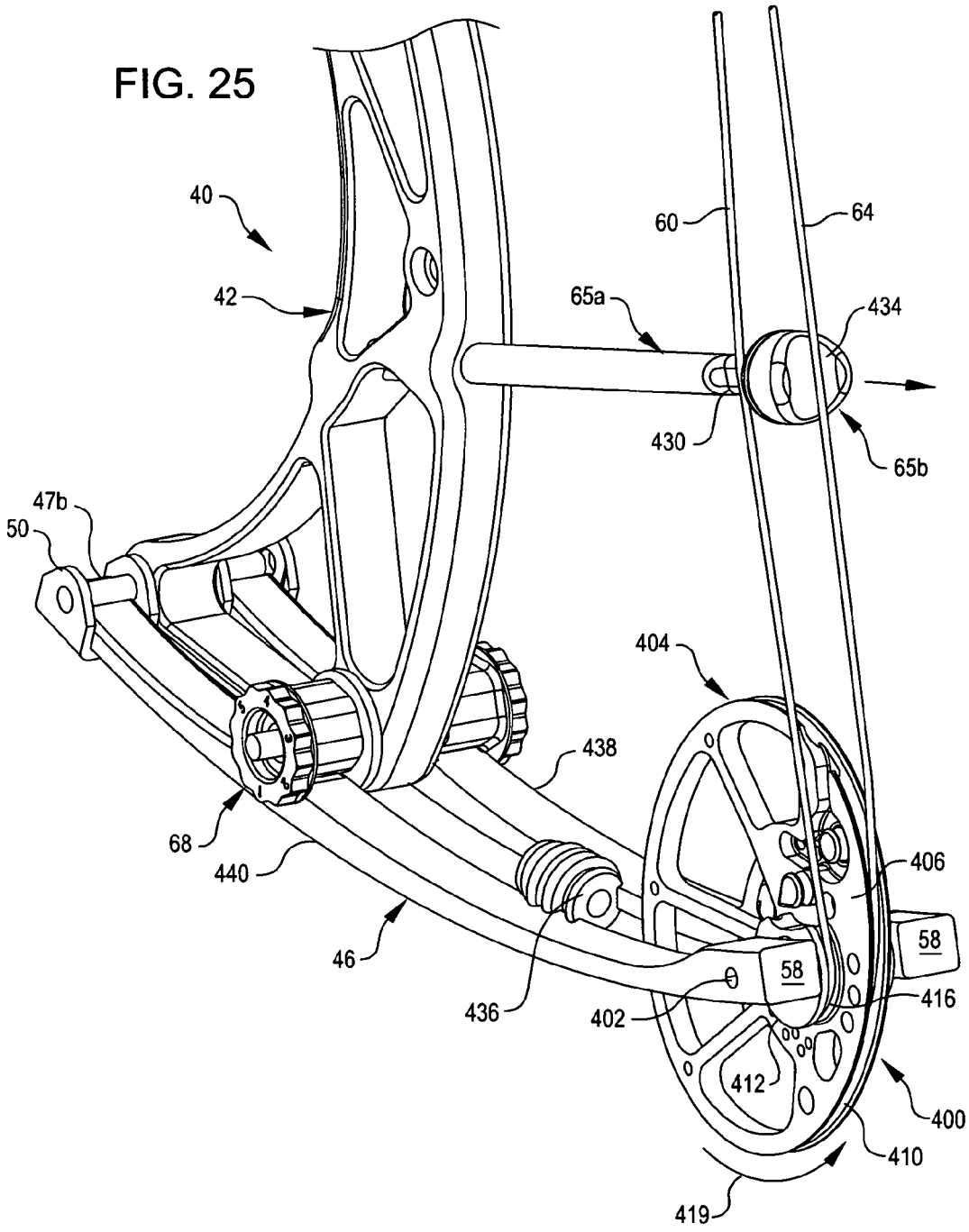
FIG. 25 is a perspective partial view of a hybrid cam compound bow equipped with a cam which embodies the principles of the present invention.

Control cable 60 rides in the track 416 of control cable element 412, and buss cable 62 rides in the track 418 of buss cable element 414 as bow 40 is drawn by pulling bow string 64 in the direction indicated by arrow 419 in FIG. 25.

Running the control and buss cable 60 and 62 in tracks 416 and 418 keeps the cables from moving side-to-side as bow 40 is drawn.

Figure 26:
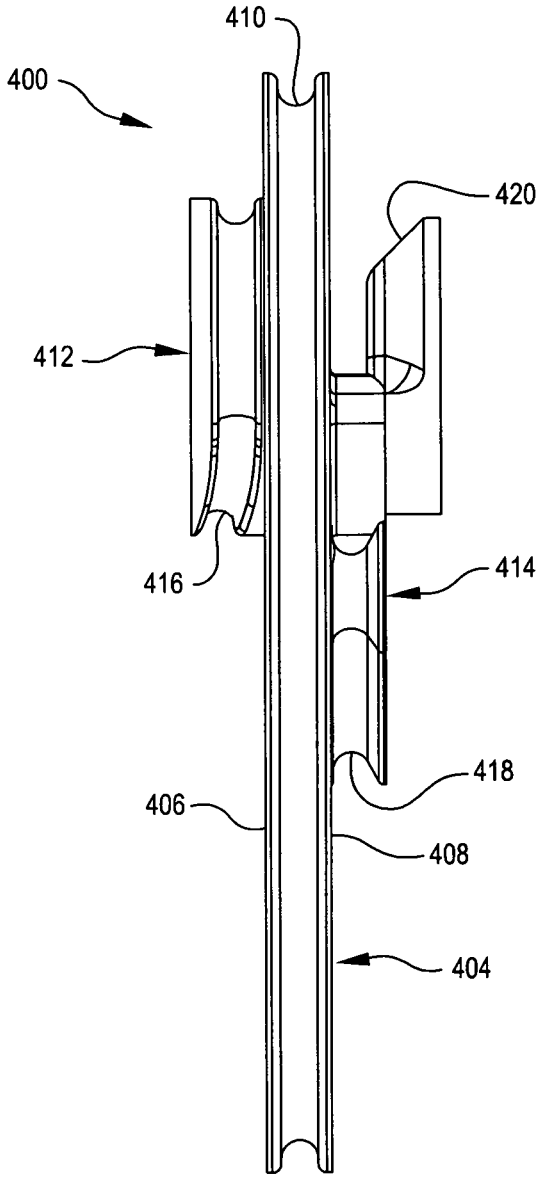
FIG. 26 is an end view of the cam.
Figure 27:
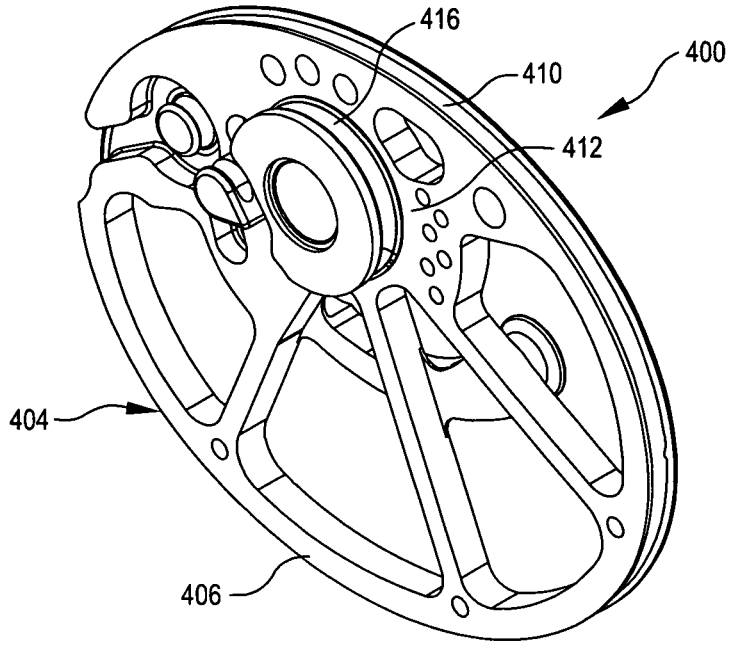
FIGS. 27 and 28 are perspective views of the control cable and buss cable sides of the FIG. 25 cam.
Figure 28:
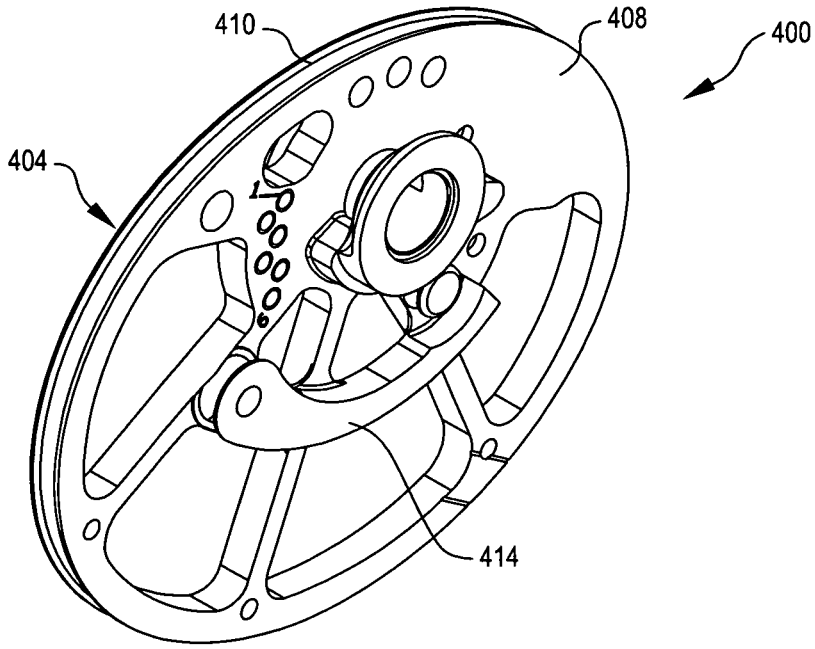

Control cable guide track 416 has an outwardly spiraling configuration as shown in FIG. 26. The spiral guide track 416 moves the control cable 60 away from the midpoint of axle 402 at the end part of the draw, offsetting the changing loads on the control and buss cables 60 and 62. For the same purpose, the buss cable and bow string tracks may have spiral configurations. That is, any or all of the tracks 410, 416, and 418 may have a similar, or other, spiral configuration.

An angled ramp 420 is mounted on the buss cable side 408 of cam wheel 404 with a gap 421 between the cam wheel and the ramp. At the end part of the draw, ramp 420 pushes the buss cable against the buss cable side 408 of cam wheel 404. This helps to keep the cam from leaning and pushes the cam back into alignment if it does lean.

Control cable 60 runs in a shallow, typically Teflon lined depression 430 formed in the guide rod 431 of a guide system 432 which also includes a bumper 433. The control cable is pushed into line by the guide rod. The guide rod is mounted to and extends rearwardly from riser 42 at a location above bottom cam 400 and below the guide rod 65*b* and cable slide 65*a*. This further constrains the control cable to in-line movement, additionally reducing noise and vibration and promoting the accuracy of bow 40. Bow string 60 rests on the rear end of bumper 433.

Elastomeric vibration dampeners can advantageously mounted to the limbs of the several bows disclosed herein to dampen vibrations generated as an arrow is shot from the bow. This contributes significantly to the accuracy of the bow. One such vibration dampener is shown in FIG. 25 and identified by reference character 436. Dampener 436 is installed between the elements 438 and 440 of limb 46.

The principles of the present invention may be embodied in forms other than those specifically disclosed herein. For example, a set of limb engageable poundage adjusters of different heights may be used instead of the herein disclosed rotating cam adjusters to adjust bow poundage. Therefore, the present embodiments are to be considered in all respects as illustrative and not restrictive, the scope of the invention being indicated by the appended claims rather than by the foregoing description; and all changes which come within the meaning and range of equivalency of the claims are therefore intended to be embraced herein.

The invention claimed is:

1. An archery bow system which comprises:

an elongated, rigid riser;

upper and lower, flexible bow limb components pivotably anchored at leading ends thereof to opposite ends of the rigid riser;

upper and lower cams rotatably supported from trailing ends of the upper and lower bow limb components;

a bow string strung between the upper and lower cams;

a fulcrum about which an associated one of the bow limb components is bent;

the fulcrum contacting the limb component at a location between the leading and trailing ends of the limb component, the fulcrum being spaced apart a leveraged distance along the limb component from where the flexible bow limb components are pivotably anchored to the riser; and the bow further comprising:

an operator-rotatable poundage adjuster cam contacting an inward side of the bow limb approximately where the fulcrum contacts the limb component, the poundage adjuster, the poundage adjuster having bow-contacting, poundage setting determining segments or elements at different predetermined distances from the axis of rotation of the cam for setting the bend in the limb component and thereby determining the poundage of the bow; and operator-viewable indicia corresponding to available poundage settings.

2. An archery bow system as defined in claim 1 in which the fulcrum is the poundage adjuster cam.

3. An archery bow system as defined in claim 1 in which the poundage adjuster comprises a cam component actuatable by an operator to displace the leading end of the bow limb component.

4. An archery bow system as defined in claim 1 which has a split limb bow:

each of the upper and lower bow limb components having a pair of spaced apart limb elements; and there being a separate fulcrum and poundage adjuster for each of the four upper limb and lower limb elements.

5. An archery bow system as defined in claim 1 which has a cross bow.

6. An archery bow system as defined in claim 1 which has a solid limb bow.

7. An archery bow system as defined in claim 1 wherein a fulcrum and a poundage adjuster are operatively associated with each of the bow limb components.

8. An archery bow system as defined in claim 7 wherein the poundage adjusters are independently operable.

9. An archery bow system as defined in claim 1 wherein the poundage adjuster comprises a step cam.

10. An archery bow system as defined in claim 1 wherein the poundage adjuster comprises a variable radius cam.

11. An archery bow system as defined in claim 10 wherein the poundage adjuster comprises a component locking the cam in a position to which it is rotated.

12. An archery bow system which comprises:

an elongated, rigid riser;

upper and lower, flexible bow limb components pivotably anchored at leading ends thereof to opposite ends of the rigid riser;

upper and lower cams rotatably supported from trailing ends of the upper and lower limb components;

a bow string strung between the upper and lower cams; and a bow poundage adjuster which comprises a fulcrum about which an associated one of the bow limb components is bent, the fulcrum being spaced apart a leveraged distance along the limb component from where the flexible bow limb components are pivotably anchored to the riser contacting an inward side of the bow limb approximately where the fulcrum contacts the limb component, the poundage adjuster;

the fulcrum having a set of limb-contacting, poundage determining segments spaced around its periphery, each of the segments being located at a different radial distance from a longitudinal axis of the fulcrum; and the poundage adjuster further comprising an operator-manipulatable component for rotating the fulcrum about the longitudinal axis to bring a selected one of the limb-contacting segments into contact with the limb component and thereby establish a bend in the limb component that corresponds to a chosen bow poundage.

13. An archery bow system as defined in claim 12 wherein the poundage determining segments are flats on the fulcrum.

14. An archery bow system as defined in claim 12 wherein the fulcrum is a variable radius cam.

15. An archery bow system as defined in claim 14 which has a locking component for positively maintaining the cam in the position to which the cam is rotated.

16. An archery bow system as defined in claim 12 which has operator-viewable indicia displaying the poundages to which the bow limb component can be set.

17. An archery bow system which comprises:

an elongated, rigid riser;

upper and lower, flexible bow limb components pivotably anchored at leading ends thereof to opposite ends of the rigid riser;

upper and lower cams rotatably supported from trailing ends of the upper and lower bow limb components;

a bow string strung between the upper and lower cams;

a fulcrum about which an associated one of the bow limb components is bent, the fulcrum being spaced apart a leveraged distance along the bow limb components from where the flexible bow limb components are pivotably anchored to the riser;

the fulcrum contacting the limb component at a location between the leading and trailing ends of the limb; and the bow system further comprising:

a poundage adjuster for setting the poundage of the bow riser contacting an inward side of the bow limb approximately where the fulcrum contacts the limb component; and operator-viewable indicia displaying the poundages to which the bow can be set.

* * * * *